United States Patent [19]

Schultze

[11] Patent Number: 4,795,315

[45] Date of Patent: Jan. 3, 1989

[54] TWO-STAGE LIQUID RING PUMP

[75] Inventor: Walter J. Schultze, Gainesville, Fla.

[73] Assignee: The Nash Engineering Company, Norwalk, Conn.

[21] Appl. No.: 175,666

[22] Filed: Mar. 24, 1988

Related U.S. Application Data

[63] Continuation of Ser. No. 1,416, Jan. 8, 1987, abandoned.

[51] Int. Cl.[4] ..... F04C 19/00

[52] U.S. Cl. ..... 417/68; 417/244

[58] Field of Search ..... 417/68, 69, 244, 54

[56] References Cited

U.S. PATENT DOCUMENTS

| | | | |
|---|---|---|---|
| 1,322,363 | 11/1919 | Siemen et al. | 417/68 |
| 1,656,728 | 1/1928 | De Lony | 417/68 |
| 2,136,527 | 11/1938 | Stelzer | 62/169 |
| 2,195,174 | 3/1940 | Jennings | 417/68 |
| 4,132,504 | 1/1979 | Fitch | 417/68 |
| 4,334,830 | 6/1982 | Haavik | 417/68 |
| 4,679,987 | 7/1987 | Olsen | 417/68 X |
| 4,685,865 | 8/1987 | Auschrat | 417/244 X |

FOREIGN PATENT DOCUMENTS

| | | | |
|---|---|---|---|
| 205156 | 9/1959 | Austria | 417/68 |
| 168138 | 1/1986 | European Pat. Off. | 417/68 |
| 258483 | 4/1913 | Fed. Rep. of Germany | 417/68 |
| 258854 | 4/1913 | Fed. Rep. of Germany | 417/68 |
| 823170 | 12/1951 | Fed. Rep. of Germany | 417/68 |
| 1047981 | 12/1958 | Fed. Rep. of Germany | 417/68 |
| 1054652 | 4/1959 | Fed. Rep. of Germany | 417/68 |
| 927115 | 10/1947 | France | 417/68 |
| 34411 | 3/1977 | Japan | 417/68 |
| 40260 | 3/1913 | Sweden | 417/68 |
| 150182 | 7/1952 | Sweden | 417/68 |
| 914809 | 3/1982 | U.S.S.R. | 417/68 |
| 1239405 | 6/1986 | U.S.S.R. | 417/68 |
| 691425 | 5/1953 | United Kingdom | 417/68 |
| 703533 | 2/1954 | United Kingdom | 417/68 |
| 710611 | 6/1954 | United Kingdom | 417/68 |
| 858422 | 1/1961 | United Kingdom | 417/68 |

*Primary Examiner*—Paul F. Neils

*Attorney, Agent, or Firm*—Robert R. Jackson

[57] ABSTRACT

A liquid ring gas pump having two axially adjacent, serially connected stages. Gas to be compressed is admitted to the first stage of the pump solely via a first stage inlet opening at the end of the first stage remote from the second stage. The sole outlet for gas to leave the first stage in order to flow to the second stage is a first stage outlet at the end of the first stage adjacent to the second stage. A residual gas outlet is provided at the end of the first stage remote from the second stage for allowing compressed gas that is unable to exit via the first stage outlet to exit via the residual gas outlet and re-enter the first stage via a residual gas inlet also provided at the end of the first stage remote from the second stage and located after the first stage inlet but before the first stage outlet in the direction of rotor rotation.

3 Claims, 3 Drawing Sheets

TWO-STAGE LIQUID RING PUMP

This application is a continuation of application Ser. No. 1,416, filed Jan. 8, 1987, now abandoned.

BACKGROUND OF THE INVENTION

This invention relates to liquid ring gas pumps, and more particularly to liquid ring gas pumps having two serially connected gas compression stages.

Various configurations of two-stage liquid ring pumps are known as shown, for example, by U.S. Pat. Nos. 4,132,504 and 4,334,830, Austrian patent No. 205,156, British patent Nos. 691,425, 703,533, 710,611, and 858,422, French patent No. 927,115, Swedish patent No. 150,182, West German patent No. 823,170, and West German Auslegeschrifts Nos. 1,047,981 and 1,054,652. The configuration of the general type shown in West German patent No. 823,170 may have certain advantages in that it employs flat-ended rotors, flat port plates, and a minimal number of ports and gas conduits. Gas to be compressed enters one end of the first stage and exits, partially compressed, from the opposite end of that stage. The partially compressed gas then flows into the adjacent end of the second stage where it is further compressed and then exits from the opposite end of that stage. Because the gas flows axially through the pump as it is compressed, pumps having this construction are sometimes known as "through-flow" pumps, and that term will sometimes be employed herein to refer to such pumps.

Although two-stage through-flow pumps do have the advantages of simplicity mentioned above, they also have certain limitations. Because in each stage the gas must travel from one axial end of the rotor to the other axial end of the rotor in less than one revolution of the rotor, it has not been practical to make either rotor longer than about one-half its diameter. If either rotor is longer than about one-half its diameter, some compressed gas may be unable to exit via the discharge port. This undischarged gas recirculates to the intake zone of the stage in which it is trapped, with the result that the work required to compress it is completely wasted and the intake capacity of the pump is reduced. Because the first stage is larger than the second stage, the first stage is usually the limiting stage in this regard.

Assuming that one wants to continue to work with pumps of the general type shown in West German patent No. 823,170, there are basically two known ways of providing increased capacity without running afoul of the limitation described above: (1) increase the diameter of the pump or (2) provide outlet openings at both ends of the first stage and convey gas from the additional first stage outlet around the outside of the first stage to the second stage. Both of these approaches have certain disadvantages. Increasing pump diameter increases pump cost by disproportionately increasing the material required to make the pump. This also increases the weight of the pump, and (in order to avoid excessive rotor tip speed) may also necessitate the use of a higher cost, lower speed motor to drive the pump. On the other hand, adding a second first-stage outlet increases the complexity and therefore the cost of the pump. The end of the first stage which has both an inlet opening and an outlet opening is necessarily more complex than in West German patent No. 823,170, as is the portion of the second stage (or interstage) into which the gas from the additional first stage outlet is introduced. Still more cost and complexity are associated with the conduit required to convey partially compressed gas from the additional first stage outlet around the outside of the first stage to the second stage.

In view of the foregoing, it is an object of this invention to provide a simpler and less expensive way to avoid the above-mentioned length to diameter ratio limitation in pumps of the type described above.

It is another object of this invention to provide a way of increasing the capacity of two-stage through-flow pumps without resorting to possibly undesirable increases in pump diameter and without the need to convey some of the partially compressed gas around the outside of the first stage to the second stage.

SUMMARY OF THE INVENTION

These and other objects of the invention are accomplished in accordance with the principles of the invention by providing a conduit for conveying partially compressed gas that would otherwise be trapped in the first stage of the pump around the first stage inlet of the pump. In particular, this conduit is located on the inlet side of the first stage and conveys gas from a location after the first stage discharge port but before the first stage inlet port in the direction of rotor rotation to a location after the first stage inlet port but before the first stage outlet port in the direction of rotor rotation. Because this conduit conveys the otherwise trapped gas around the first stage inlet port, the trapped gas does not reduce the intake capacity of the pump, and at least some of the energy required to compress that gas is conserved. Pump capacity can therefore be increased by increasing the length rather than the diameter of the pump and without resorting to the provision of a second first-stage outlet port, a conduit for conveying gas from that outlet port axially around the first stage, and means for introducing gas from that conduit into the second stage.

Further features of the invention, its nature and various advantages will be more apparent from the accompanying drawings and the following detailed description of the invention.

DETAILED DESCRIPTION OF THE INVENTION

Figure 1:
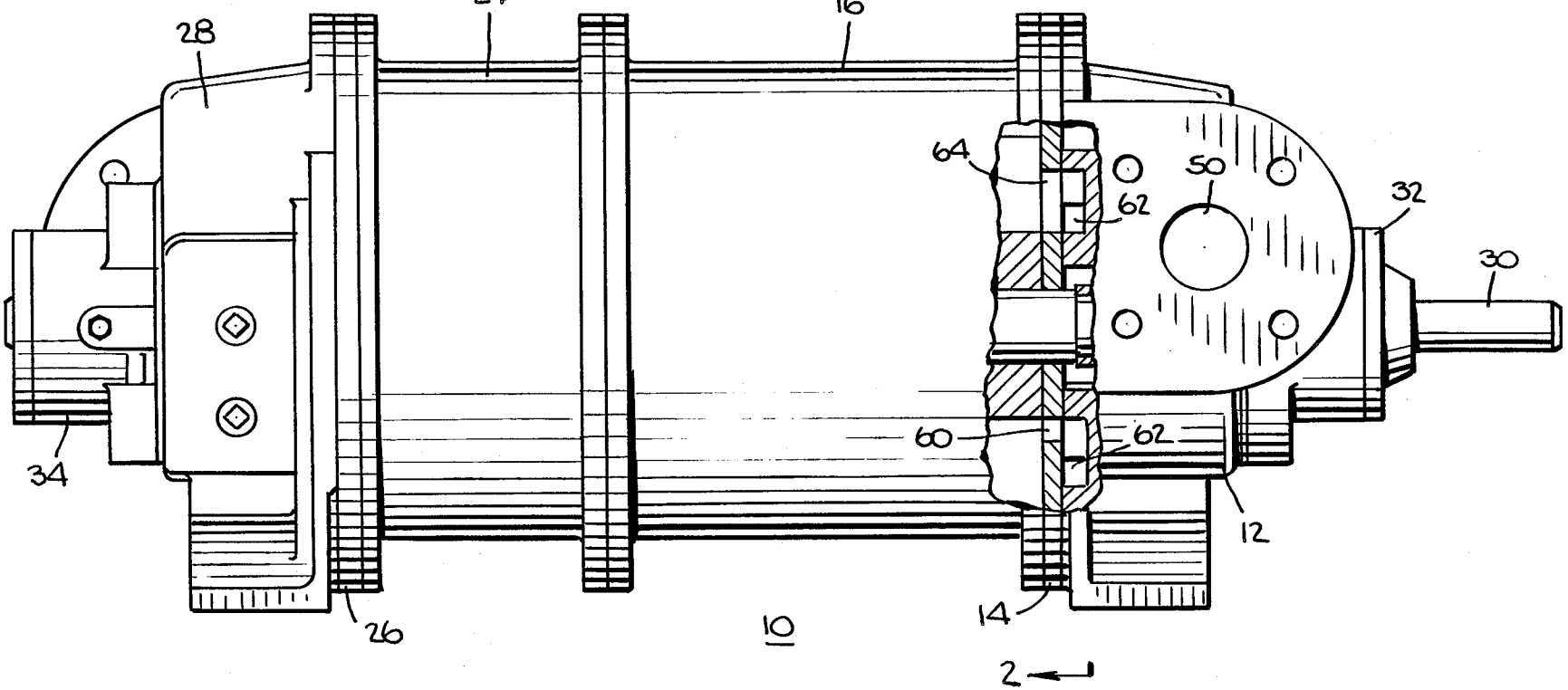
FIG. 1 is an elevational view, partly in section, of a two-stage liquid ring pump constructed in accordance with the principles of this invention. The sectional portion of FIG. 1 is taken along the line 1—1 in FIG. 2.
Figure 2:
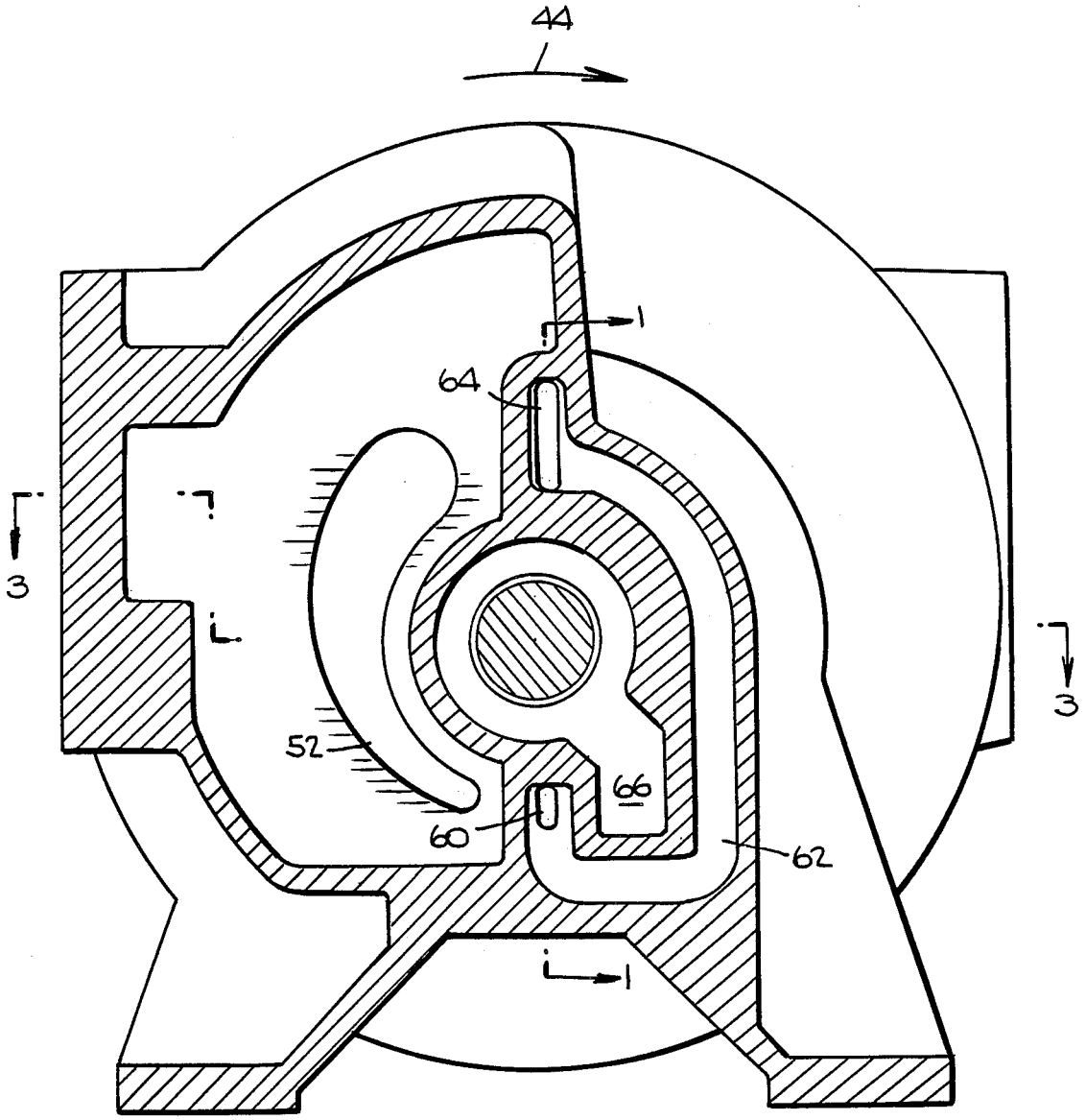
FIG. 2 is a sectional view taken along the line 2—2 in FIG. 1.
Figure 3:
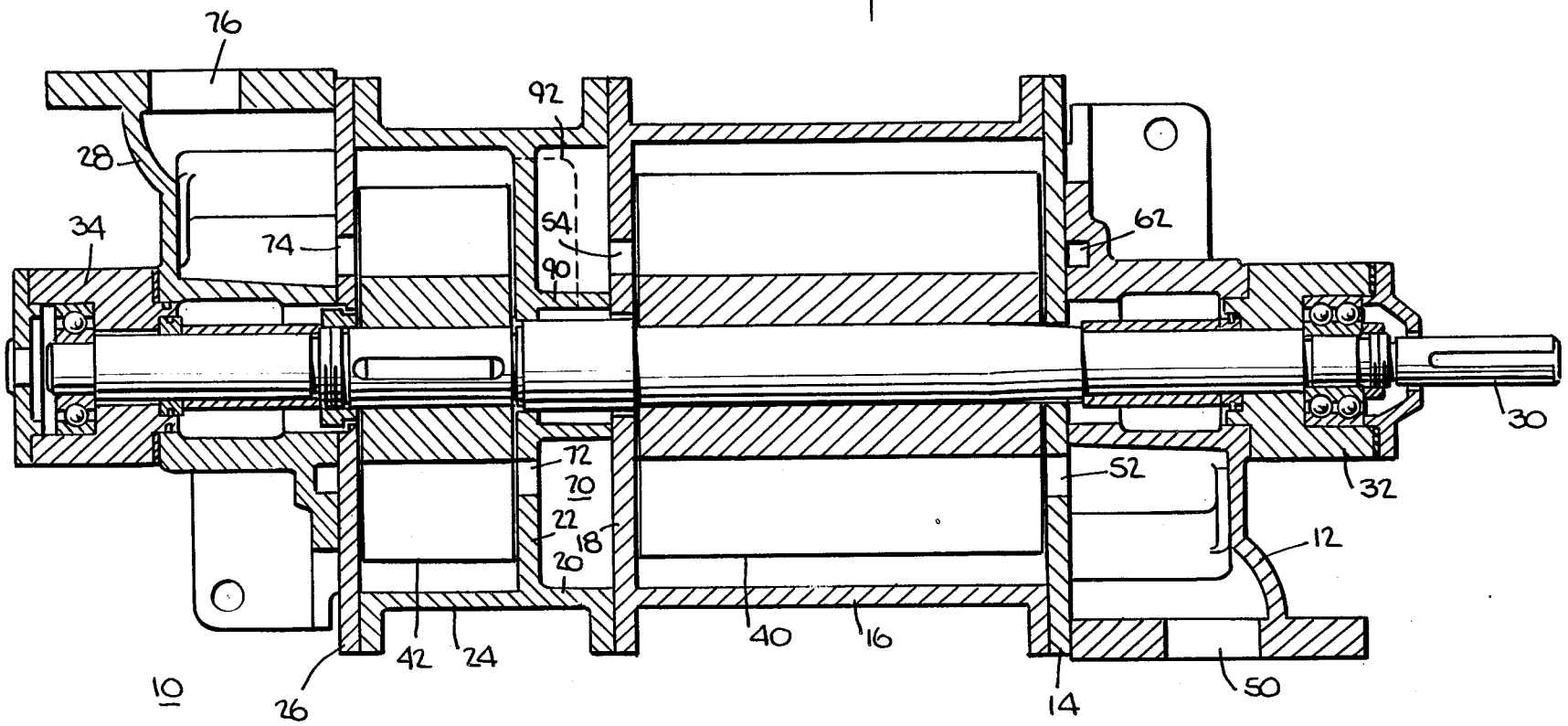
FIG. 3 is a sectional view taken along the line 3—3 in FIG. 2.

As shown in the drawings, a two-stage liquid ring pump 10 constructed in accordance with the principles of this invention includes first stage head member 12, first stage inlet port member 14, first stage housing member 16 (including first stage outlet port member 18), second stage housing member 24 (including interstage head portion 20 and second stage inlet port member 22), second stage outlet port member 26, and second stage head member 28. Shaft 30 is rotatably mounted in the foregoing members by means of bearing assemblies 32 and 34 adjacent respective opposite axial ends of the pump. First stage rotor 40 is fixedly mounted on shaft 30 inside first stage housing member 16 between first stage inlet port member 14 and first stage outlet port member 18. Second stage rotor 42 is fixedly mounted on shaft 30 between second stage inlet port member 22 and second stage outlet port member 26. Rotors 40 and 42 rotate (with shaft 30) in the direction indicated by arrow 44 in FIG. 2.

Gas to be pumped enters first stage head member 12 via conduit 50 and enters the first stage of the pump via first stage inlet port 52 in port member 14. As is conventional in liquid ring pumps, first stage housing 16 is partly filled with pumping liquid (usually water) and is somewhat eccentric relative to rotor 40. As rotor 40 rotates, it engages the pumping liquid and forms it into a recirculating eccentric ring inside housing 16. On the side of the pump including inlet port 52 the inner surface of this ring is receding from shaft 30 in the direction of rotor rotation. This causes gas to be drawn into the spaces between the blades of rotor 40 in this region of the pump. On the opposite side of the pump (i.e., the side including discharge port 54) the inner surface of the liquid ring is converging toward shaft 30 in the direction of rotor rotation. Accordingly, on this side of the pump the gas is compressed between the blades of rotor 40 and the partially compressed gas is discharged from the first stage via first stage discharge port 54 in port member 18.

Because the first stage of pump 10 is relatively long (i.e., the length of rotor 40 is at least about one-half its diameter), not all of the partially compressed gas may be able to exit via discharge port 54. In particular, some of the partially compressed gas may be trapped near first stage inlet port member 14. In accordance with this invention, in order to prevent this trapped gas from recirculating to inlet port 52 (where it would reduce the amount of new gas that could be drawn into the pump), residual gas outlet port 60 is provided in port member 14 at a location after discharge port 54 but before inlet port 52 in the direction of rotor rotation to allow this partially compressed gas to exit from the first stage of the pump. Outlet port 60 communicates with residual gas conduit 62 in head member 12. Residual gas conduit 62 conveys the gas from outlet port 60 to residual gas inlet port 64, which is also provided in port member 14, but at a location after inlet port 52 and before discharge port 54 in the direction of rotor rotation. Accordingly, the gas from conduit 62 re-enters the first stage at a point where it does not interfere with the intake of new gas via inlet port 52 and where at least a portion of its compression is preserved. Conduit 62 keeps the gas flowing therethorough separate from both the intake gas in conduit 50 and the conventional make-up pumping liquid flow in conduit 66. Conduit 62 is formed as a channel in the surface of head member 14 which is otherwise in contact with port member 14. Conduit 62 extends part way around the pump, conveying the gas flowing therein around one side of shaft 30, as well as around make-up pumping liquid conduit 66.

Elements 60, 62, and 64 allow the first stage of pump 10 to be made much longer (in relation to its diameter) than it could otherwise be made without resorting to some of the other, relatively disadvantageous expedients mentioned above. In particular, elements 60, 62, and 64 allow the length of rotor 40 to be made considerably longer than one-half its diameter. For example, the length of rotor 40 can be from about 0.5 to about 1.2 or more times its diameter, preferably from about 0.5 to about 1.0 times its diameter. This may avoid the need for a larger diameter pump, or may permit the use of a smaller diameter pump, with the possibly attendant advantages mentioned above (e.g., lighter weight, lower cost, greater operating efficiency, and/or higher motor speed (thereby reducing motor cost)). It also avoids the need for another discharge port like port 54 in port member 14, which would increase the size and complexity of head member 12 and require the addition of a conduit from that additional discharge port, axially around first stage housing 16, to some point at which the gas flowing in that additional conduit could be introduced into the second stage of the pump. By comparison with that alternative, the structure of this invention is simpler, more compact, and more economical.

Continuing now with the description of pump 10, the partially compressed gas from discharge port 54 flows through interstage passage 70 and enters the second stage of the pump via second stage inlet port 72 in port member 22. The second stage operates in a manner similar to the first stage to further compress the gas and to discharge the fully compressed gas via second stage discharge port 74 in port member 26. The fully compressed gas exits the pump via conduit 76. If desired, second stage discharge port 74 can be provided with a partial check valve arrangement (not shown but of a well-known type such as one or more ball or flapper valves) to prevent over-compression in the second stage when the pump is being started. Also if desired, to reduce the number of different parts required to produce pump 10, head member 28 can be identical to head member 12. The structural counterpart of conduit 62 would then be present in head member 28 but would not be used. To help prevent interstage gas leakage, the interstage portion of shaft 30 can be surrounded by an annular collar 90 extending axially between first stage outlet port member 18 and second stage inlet port member 22. The annular clearance between shaft 30 and collar 90 can be filled with high pressure pumping liquid preferably withdrawn from a high pressure portion of the second stage liquid ring and supplied to the annular clearance by schematically represented conduit 92.

I claim:

1. A two-stage liquid ring pump having axially adjacent first and second stages comprising:

a stationary housing;

a first stage rotor rotatably mounted in the housing;

a first port plate mounted on the housing at the axial end of the first stage rotor remote from the second stage;

a first stage gas inlet opening through said first port plate, said first stage inlet being the sole means by which gas can enter the pump;

a first stage gas outlet opening at the axial end of the first stage rotor adjacent to the second stage, said first stage outlet being the sole means by which gas can flow from said first stage to the second stage;

a residual gas outlet opening through said first port plate for allowing compressed gas not discharged via the first stage outlet to exit from the first stage;

a residual gas inlet opening through said first port plate for admitting to the first stage gas supplied to the residual gas inlet, the residual gas inlet being located after the first stage inlet but before the first stage outlet in the direction of rotor rotation; and means for conveying gas from the residual gas outlet to the residual gas inlet, said means comprising:

a first head member mounted against the surface of said first port plate which faces away from said rotor, the surface of said first head member which abuts said surface of said first port plate being recessed to define a channel extending from said residual gas outlet to said residual gas inlet, said channel cooperating with said surface of said first port plate to define a conduit for conveying gas from said residual gas outlet to said residual gas inlet.

2. The pump defined in claim 1 wherein the residual gas outlet is located after the first stage outlet but before the first stage inlet in the direction of rotor rotation.

3. A two-stage liquid ring pump having axially adjacent first and second stages comprising:

a stationary housing;

a first stage rotor rotatably mounted in the housing;

a second stage rotor rotatably mounted in the housing;

a first port plate mounted on the housing at the axial end of the first stage rotor remote from the second stage;

a first stage gas inlet opening through said first port plate, said first stage inlet being the sole means by which gas can enter the pump;

a first stage gas outlet opening at the axial end of the first stage rotor adjacent to the second stage, said first stage outlet being the sole means by which gas can flow from said first stage to the second stage;

a second stage gas inlet opening at the axial end of the second stage rotor adjacent to the first stage;

a second stage gas outlet opening at the axial end of the second stage rotor remote from the first stage;

means for conveying gas from the first stage outlet to the second stage inlet;

a residual gas outlet opening through said first port plate for allowing compressed gas not discharged via the first stage outlet to exit from the first stage;

a residual gas inlet opening through said first port plate for admitting to the first stage gas supplied to the residual gas inlet, the residual gas inlet being located after the first stage inlet but before the first stage outlet in the direction of rotor rotation; and means for conveying gas from the residual gas outlet to the residual gas inlet, said means comprising:

a first head member mounted against the surface of said first port plate which faces away from said rotor, the surface of said first head member which abuts said surface of said first port plate being recessed to define a channel extending from said residual gas outlet to said residual gas inlet, said channel cooperating with said surface of said first port plate to define a conduit for conveying gas from said residual gas outlet to said residual gas inlet.

* * * * *